US005417840A

United States Patent [19]

Block et al.

[11] Patent Number: 5,417,840

[45] Date of Patent: May 23, 1995

[54] ALKALINE ZINC-NICKEL ALLOY PLATING BATHS

[75] Inventors: Dale G. Block, Shaker Heights; Craig V. Bishop, Lakewood, both of Ohio

[73] Assignee: McGean-Rohco, Inc., Cleveland, Ohio

[21] Appl. No.: 140,588

[22] Filed: Oct. 21, 1993

[51] Int. Cl.[6] ..... C25D 3/56

[52] U.S. Cl. ..... 205/246; 205/244; 205/255

[58] Field of Search ..... 205/246, 244, 255

[56] References Cited

U.S. PATENT DOCUMENTS

| | | | |
|---|---|---|---|
| 2,824,857 | 2/1958 | Dreschel | 260/77.5 |
| 2,876,177 | 3/1959 | Gundel et al. | 204/49 |
| 3,280,130 | 10/1966 | Gundel | 260/286 |
| 3,314,868 | 4/1967 | Willmund et al. | 204/49 |
| 3,862,019 | 1/1975 | Rosenberg et al. | 204/49 |
| 3,972,787 | 8/1976 | Nobel et al. | 205/265 |
| 4,022,676 | 5/1977 | Popescu | 204/55 R |
| 4,162,947 | 7/1979 | Canaris et al. | 204/55 R |
| 4,366,036 | 12/1982 | Lash et al. | 204/55 R |
| 4,421,611 | 12/1983 | Cameron | 204/43 T |
| 4,662,999 | 5/1987 | Opaskar et al. | 204/44.4 |
| 4,861,442 | 8/1989 | Nishihama et al. | 204/44.2 |
| 4,877,496 | 10/1989 | Yanagawa et al. | 204/44.2 |
| 4,889,602 | 12/1989 | Oshima et al. | 204/38.1 |
| 4,983,263 | 1/1991 | Yasuda et al. | 205/246 |
| 5,049,286 | 9/1991 | Tremmel et al. | 204/49 |

FOREIGN PATENT DOCUMENTS

| | | |
|---|---|---|
| 298192 | 12/1989 | Japan . |
| 1170058 | 11/1969 | United Kingdom . |

*Primary Examiner*—John Niebling
*Assistant Examiner*—Kishor Mayekar
*Attorney, Agent, or Firm*—Renner, Otto, Boisselle & Sklar

[57] ABSTRACT

An aqueous alkaline plating bath for the electrodeposition of a zinc-nickel alloy coating on a substrate is described. The plating bath generally comprise (A) zinc ions;

(B) nickel ions; and (C) at least one heterocyclic compound having the general formula $$RN^{+}-R^{1}-Y^{(-)a}(X^{-})_{b} \quad (I)$$

wherein RN is an aromatic heterocyclic nitrogen-containing group, $R^1$ is an alkylene or hydroxy alkylene group, Y is $-OSO_3$, $-SO_3$, $-COOH$, $-CONH_2$ or $-OH$, X is a halide, a and b=0 or 1, and the sum of a+b=1. Preferably, additional additives are included in the plating bath to improve the properties of the deposited alloy. For example, polymers of aliphatic amines may be included to improve the level of the deposits and metal complexing agents such as hydroxyalkyl-substituted polyamines also may be included. The plating baths of the invention are effective depositing bright alloys over a wide current density range.

22 Claims, No Drawings

ALKALINE ZINC-NICKEL ALLOY PLATING BATHS

TECHNICAL FIELD

This invention relates to aqueous alkaline plating baths and to the electrodeposition of a bright zinc-nickel alloy from such baths. More particularly, the invention relates to alkaline zinc-nickel alloy plating baths containing certain aromatic heterocyclic nitrogen-containing compounds.

BACKGROUND OF THE INVENTION

Considerable research has been devoted over the years to provide improved corrosion protection to metallic surfaces. One way of providing this corrosion protection is by electrodepositing a zinc coating on the surface. For decades, electroplated zinc has been used by the automotive industry to provide an economical, highly corrosion-resistant coating. However, with continued demands for higher quality and extended warranties, both the automotive manufacturers and their suppliers have had to develop new coatings. The best overall performance is being demonstrated by zinc-cobalt and zinc-nickel alloy platings. These alloys are being used as replacements for conventional zinc electroplates in automotive as well as other applications requiting extended corrosion-resistance. The term "alloy," as used in this specification and claims is defined as a mixture of two or more metallic elements which may be microscopically homogeneous or microscopically heterogeneous.

The improvement of zinc-nickel alloys has been demonstrated by superior salt spray performance when comparing zinc-nickel to zinc electrodeposits. The amount of nickel in the zinc-nickel electrodeposit that is useful for improved corrosion protection has been found to be from about 4% to about 18% nickel with an optimum level of about 10% to 12%.

Typically, acid zinc-nickel alloy plating baths have been based on inorganic zinc and nickel salts such as zinc sulfate, zinc chloride, nickel sulfate or nickel chloride, and the baths contain various additives to improve the brightness and the grain structure of the deposit and provide control of the zinc to nickel ratio.

U.S. Pat. No. 2,876,177 (Grundel et al) describes nickel electroplating baths containing internal salts of quaternary ammonium-N-alkyl sulfonic acids wherein the electroplating baths are Watts-type acid nickel electroplating baths. Acid zinc-nickel alloy plating baths generally contain an acid such as boric acid or sulfuric acid and other additives such as brightening agents, wetting agents, etc. U.S. Pat. No. 3,862,019 (Rosenberg et al) describes an aqueous acid electroplating bath which contains nickel salts and as brightening agents, the synergistic combination of N-(3-sulfopropyl) pyridinium inner salt and an acetylenic alcohol-ethylene oxide adduct.

U.S. Pat. No. 4,421,611 (Cameron) describes an aqueous acidic plating bath for the electrodeposition of nickel or a nickel-iron alloy which comprises nickel ions or a mixture of nickel ions and iron ions, certain acetylenic acid compounds and, optionally, an aromatic heterocyclic nitrogen-containing compound generally referred to as sulfo-betaines.

Aqueous alkaline zinc-nickel alloy plating baths also are known and have been described in the art. For example, U.S. Pat. No. 4,861,442 (Nishihama et al) describes aqueous alkaline baths comprising zinc and nickel ions, alkali metal hydroxide, an amino alcohol polymer, a nickel complexing agent, and an amino acid and/or a salt of an amino acid. The pH of the bath is 11 or higher.

U.S. Pat. No. 4,877,496 (Yanegawa et al) describes aqueous alkaline baths comprising zinc and nickel ions, an alkali metal hydroxide, a metal complexing agent, a primary brightener, and a booster brightener. The primary brightener is a reaction product of an amine such as ethylenediamine with epihalohydrin. The booster brightener is at least one aromatic aldehyde. Tertiary brighteners such as tellurium oxide, tellurous acid or its salts or telluric acid and its salts also can be included in the baths.

U.S. Pat. No. 4,889,602 (Oshima et al) describes aqueous plating baths having a pH of more than 11 and comprising zinc and nickel ions, and at least one compound from the group consisting of (i) aliphatic amines, (ii) polymers of aliphatic amines, or (iii) a compound selected from the group consisting of hydroxyaliphatic carboxylic acids and salts.

SUMMARY OF THE INVENTION

An aqueous alkaline plating bath for the electrodeposition of a zinc-nickel alloy coating on a substrate is described. The plating bath generally comprise (A) zinc ions;

(B) nickel ions; and (C) at least one heterocyclic compound having the general formula $$RN^{+}—R^{1}—Y^{(-)a}(X^{-})_{b} \quad (I)$$

wherein RN is an aromatic heterocyclic nitrogen-containing group, $R^1$ is an alkylene or hydroxy alkylene group, Y is $—OSO_3$, $—SO_3$, —COOH, $—CONH_2$ or —OH, X is a halide, a and b=0 or 1, and the sum of a+b=1. Preferably, additional compositions are included in the plating bath to improve the properties of the deposited alloy. For example, polymers of aliphatic amines may be included to improve the level of the deposits, and metal complexing agents such as hydroxyalkyl-substituted polyamines also may be included. The plating baths of the invention are effective in depositing bright alloys over a wide current density range.

DESCRIPTION OF THE PREFERRED EMBODIMENTS

The improved zinc-nickel alloy electroplating baths of the present invention comprise an aqueous alkaline solution containing zinc ions, nickel ions and at least one aromatic heterocyclic nitrogen-containing compound as described more fully below. The alkaline plating baths are free of cyanide.

The plating baths of the invention contain an inorganic alkaline component in sufficient quantity to provide the bath having the desired pH. Generally, the amount of the alkaline component contained in the plating bath will be an amount sufficient to provide a bath having the desired pH which is generally at least 10, and more often, at least about 11. Amounts of from about 50 to about 220 grams of alkaline component per liter of plating bath may be utilized, and more often, the amount will be from about 90 to about 110 grams per liter. The alkaline component generally is an alkali metal derivative such as sodium hydroxide, potassium hydroxide, sodium carbonate, potassium carbonate, etc.

The alkaline plating baths of the present invention generally will contain zinc ion at concentrations ranging from about 1 to about 100 g/l at concentrations of from about 4 to about 30 g/l being preferred. The zinc ion may be present in the bath in the form of a soluble salt such as zinc oxide, zinc sulfate, zinc carbonate, zinc acetate, zinc sulfate, zinc sulfamate, zinc hydroxide, zinc tartrate, etc.

The plating baths of the present invention also contain from about 0.1 to about 50 g/l of nickel ions, and more often, the bath will contain from about 0.5 to about 20 g/l of nickel ions. Sources of nickel ions which can be used in the plating baths include nickel hydroxide, inorganic salts of nickel, and organic acid salts of nickel. Preferred examples of nickel sources include nickel hydroxide, nickel sulfate, nickel carbonate, ammonium nickel sulfate, nickel sulfamate, nickel acetate, nickel formate, nickel bromide, etc. The nickel and zinc sources which may be used in the plating baths of the invention may comprise one or more of the above-described zinc sources and one or more of the above-described nickel sources.

The plating baths of the invention also contain at least one aromatic heterocyclic nitrogen-containing compound which improves the level and brightness of the zinc nickel alloy deposited from the baths. In one embodiment, the aromatic heterocyclic nitrogen-containing compounds are characterized by the formula $$RN^{+}-R^{1}-Y^{(-)a}(X^{-})_{b} \quad (I)$$

wherein RN is an aromatic heterocyclic nitrogen-containing group, $R^1$ is an alkylene or hydroxy alkylene group, Y is $-OSO_3$, $-SO_3$, $-COOH$, $-CONH_2$ or $-OH$, X is a halide, a and b=0 or 1, and the sum of a+b=1.

When a=1 and b=0, the heterocyclic compounds are internal salts and may be represented by the formula $$RN^{+}-R^{1}-Y^{-} \quad (IA)$$

When a=0 and b=1, the heterocyclic compound may be represented by the formula $$[RN^{+}-R^{1}-Y]X^{-} \quad (IB)$$

Compounds of the type represented by Formula IA wherein Y is $-SO_3$ or $-OSO_3$ are referred to as sulfo-betaines.

Generally, the RN group will be an aromatic nitrogen-containing group such as pyridine, substituted pyridines, quinoline, substituted quinolines, isoquinoline, substituted isoquinolines, and acridines. The aromatic heterocyclic nitrogen-containing group RN may contain two or more nitrogen atoms in the ring. For example, the RN group may be a pyrazine, pyrimidine, or a benzimidazole group. In those instances wherein the RN group contains more than one nitrogen atom, the heterocyclic compound of Formula I, IA and IB may contain two or more of the $-R^1-Y^-$ groups. Various substituents can be incorporated into the aromatic nitrogen-containing groups specified above, and the substituent may be attached to the various positions of the aromatic group. Examples of substituents include hydroxy, alkoxy, halide, lower alkyl, lower alkenyl, amino alkyl, mercapto, cyano, hydroxyalkyl, acetyl, benzoyl, etc.

The $R^1$ group in Formula I, IA and IB, is an alkylene or hydroxy alkylene group generally containing from 1 to about 10 or more carbon atoms, generally in a straight chain. In one embodiment, $R^1$ is an alkylene or hydroxy alkylene group containing from 2 to 4 carbon atoms in a straight chain. Specific examples of the alkylene and hydroxy alkylene groups ($R^1$) include ethylene, methylene, propylene, butylene, 2-hydroxy propylene, etc. The Y group present in Formula I, IA and IB may be an $-OSO_3$, $-SO_3$, $-COOH$, $-CONH_2$ or $-OH$ group or the corresponding alkali metal salts of said groups such as $-SO_3Na$, $-COONa$, $-COOK$, etc. In one embodiment, the heterocyclic compounds (C) wherein Y is $OSO_3$, $SO_3$ or COOH may be in the form of the corresponding alkali metal salts produced by reacting the compound with a suitable inorganic alkali metal base. This reaction is illustrated with the heterocyclic compounds wherein Y is $SO_3$ as follows:

$$RN^{+}-R^{1}-SO_3^{-}+NaOH \rightarrow RN(OH)SO_3Na$$

In Formulae I and IB, X is a halide. Preferably, X is chlorine.

In one preferred embodiment, the aromatic heterocyclic nitrogen-containing compounds (C) used in the plating baths of the present invention are characterized by Formula IA wherein Y is an $-SO_3$ or $-OSO_3$ group. As mentioned, such heterocyclic compounds are referred to as sulfo-betaines.

More particularly the sulfo-betaine compounds can be characterized by the following formulae

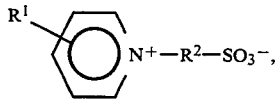

(IC)

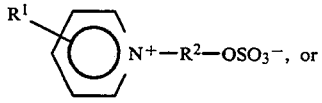

(ID)

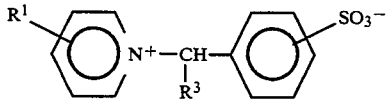

(IE)

wherein $R^1$ is hydrogen, benzo(b), or one or more lower alkyl, halide, hydroxy, lower alkenyl or lower alkoxy groups, each $R^2$ is all alkylene or hydroxy alkylene group containing 3 or 4 carbon atoms in a straight chain, and $R^3$ is hydrogen or a hydroxyl group.

As can be seen from Formulae IC, ID and IE, the sulfo-betaines contain a pyridinium portion which may be an unsubstituted pyridine ring or a substituted pyridine ring. Thus, $R^1$ may be one or more lower alkyl groups, halogen groups, lower alkoxy groups, hydroxy groups or lower alkenyl groups.

More specific examples of the pyridine groups which may be included in the above Formulae IC–IE include pyridine, 4-methyl pyridine (picoline), 4-ethyl pyridine, 4-t-butyl pyridine, 4-vinyl pyridine, 3-chloro pyridine, 4-chloro pyridine, 2,3 or 2,4 or 2,6 or 3,5-di-methyl pyridine, 2-methyl-5-ethyl pyridine, 3-methyl pyridine, 3-hydroxy pyridine, 2-methoxy pyridine, 2-vinyl pyridine.

In Formula IC, $R^2$ can be an alkylene or hydroxy alkylene group containing 3 or 4 carbon atoms in a straight chain which may contain alkyl substituents which may be represented by Formula IF

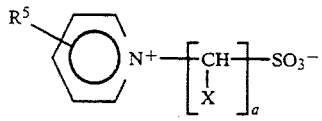

(IF)

wherein $R^5$ is hydrogen or a lower alkyl group, one X is hydrogen, hydroxy or a hydroxy methyl group, the remaining X are hydrogen, and a is 3 or 4.

The preparation of the sulfo-betaines of Formula IC wherein $R^2$ is an alkylene group is described in, for example, U.S. Pat. No. 2,876,177, which disclosure is incorporated by reference. Briefly, the compounds are formed by reaction of pyridine or a substituted pyridine with lower 1,3- or 1,4-alkyl sultones. Examples of such sultones include propane sultone and 1,3- or 1,4-butane sultone. The reaction products formed thereby are internal salts of quaternary ammonium-N-propane-omega-sulfonic acids or the corresponding butane derivative, depending on the alkyl sultone used.

The preparation of the sulfo-betaine of Formula IC wherein $R^2$ is a hydroxy alkylene group is described in, for example, U.S. Pat. No. 3,280,130. The method described in this patent involves a first reaction step wherein pyridine is reacted with epichlorohydrin in the presence of hydrochloric acid, and, thereafter, in a second reaction step, the quaternary salt formed thereby is reacted with sodium sulfite. The disclosure of U.S. Pat. No. 3,280,130 is incorporated by reference.

Preferred examples of the sulfo-betaines wherein $R^2$ is a hydroxy alkylene group including pyridine compounds of the Formula IF wherein $R^5$ is hydrogen, one or more lower alkyl groups or a benzo(b) group, a is 3 or 4, one X substituent is a hydroxyl group and the others are hydrogen. In an alternative embodiment, two of the X groups could be hydrogen and the third X group could be a hydroxy alkyl group, preferably, a hydroxy methyl group.

The sulfo-betaines useful in the baths of the invention also include sulfo-betaines of the type represented by Formula ID above wherein $R^1$ is defined as in Formula I, and $R^2$ is an alkylene or hydroxy alkylene group containing 2 or 3 carbon atoms in a straight chain and optionally pendant hydroxyl groups, hydroxyl alkyl groups or alkyl groups containing 1 or 2 carbon atoms. Preferred examples of the betaines represented by Formula ID are those wherein $R^1$ includes compounds of the formula

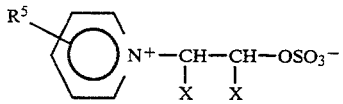

(IG)

wherein $R^5$ is hydrogen, a lower alkyl group or a benzo(b) group, and both X groups are hydrogen or one X is hydrogen and the other is a hydroxyl group.

The preparation of the sulfo-betaines of the type represented by Formulae ID and IG which are known as pyridinium-alkane sulfate betaines is known in the art. For example, the sulfate betaines can be prepared by reacting a pyridine compound with an alkanol compound containing a halogen atom to form an intermediate hydroxyalkyl pyridinium-halide which is thereafter reacted with the corresponding halosulfonic acid to form the desired betaine. Specifically, pyridinium(ethyl sulfate-2) betaine can be prepared by reacting ethylene chlorohydrin with pyridine followed by reaction with chlorosulfonic acid. The details of the procedure are described in U.S. Pat. No. 3,314,868 and the disclosure is hereby incorporated by reference. Other alkanol compounds containing a halogen which can be reacted with pyridine to form the desired betaines include 1-chloro-2-propanol, 3-chloro-1-propanol, etc.

The useful betaines also include those represented by Formula IE given above which may be obtained by reacting, for example, o-chloro benzyl chloride (prepared from o-chloro benzaldehyde) with pyridine or a substituted pyridine followed by replacement of the o-chloro group with a sulfonic acid group. Although a similar reaction can be conducted with the corresponding meta- and para-chloro compounds, the ortho derivative performs best in the plating baths of the invention.

Specific examples of aromatic heterocyclic nitrogen-containing compounds characterized by Formula I and more particularly Formula IA wherein Y is $—SO_3$ or $OSO_3$ include the following:

pyridinium-N-propane-3-sulfonic acid
pyridinum-N-butane-4-sulfonic acid
pyridinium-N-(2-hydroxy)-propane-3-sulfonic acid
picolinium-N-propane-3-sulfonic acid
picolinium-N-butane-4-sulfonic acid
picolinium-N-(2-hydroxy)-propane-3-sulfonic acid
2,4-dimethyl-pyridinium-N-propane-3-sulfonic acid
3-bromo-pyridinium-N-propane-3-sulfonic acid
quinolinium-N-propane-3-sulfonic acid
quinolinium-N-butane-4-sulfonic acid
quinolinium-N-(2-hydroxy)-propane-3-sulfonic acid
quinaldinium-N-propane-3-sulfonic acid
acridinium-N-propane-3-sulfonic acid
pyrodinium-N-ethane-2-sulfate
pyrazimium-N,N'-di(propane)-3-sulfonic acid Examples of the aromatic heterocyclic nitrogen-containing compounds of Formula I and IB wherein Y is COOH, $CONH_2$ or OH include:

N-carboxymethyl pyridinium chloride
N-carboxymethyl quinolinium chloride
N-(2-hydroxyethyl) pyridinium chloride
N-(2-carboxamidoethyl) pyridinium chloride The amount of aromatic heterocyclic nitrogen-containing compound (C) included in the aqueous alkaline plating baths of the present invention is an amount which is sufficient to provide the desired improvement in the level and brightness of the deposited zinc-nickel alloy. Amounts of from about 0.1 to about 20 g/l are usually sufficient to provide the desired improvements. More often, the amount of the heterocyclic nitrogen-containing compound included in the plating baths will be within the range of from about 0.1 to about 10 g/l.

It often is desirable to include in the alkaline plating baths of this invention one or more additional components to provide improved and stable plating baths and to provide for improved zinc-nickel alloys. For example, alkaline plating baths may contain metal-complexing agents, aromatic aldehydes to improve the gloss or brightness of the alloy, polymers of aliphatic amines, surface-active agents, etc.

In one embodiment, the aqueous alkaline plating baths of the present invention will contain (D) at least one polymer of an aliphatic amine. The amount of the polymer of an aliphatic amine contained in the aqueous alkaline plating baths of the present invention may range from about 5 to about 150 g/l and more often will be in the range of from about 25 to about 60 g/l.

Typical aliphatic amines which may be used to form polymers include 1,2-alkyleneimines, monoethanolamine, diethanolamine, triethanolamine, ethylenediamine, diethylenetriamine, imino-bis-propylamine, triethylenetetramine, tetraethylenepentamine, hexamethylenediamine, etc.

Polymers derived from 1,2-alkyleneimines are preferred and the alkyleneimines may be represented by the general formula

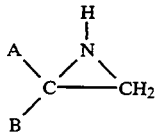

(II)

wherein A and B are each independently hydrogen or alkyl groups containing from 1 to about 3 carbon atoms. Where A and B are hydrogen, the compound is ethyleneimine. Compounds wherein either or both A and B are alkyl groups are referred to herein generically as alkyleneimines although such compounds have been referred to also as ethyleneimine derivatives.

Examples of poly(alkyleneimines) which are useful in the present invention include polymers obtained from ethyleneimine, 1,2-propyleneimine, 1,2-butyleneimine and 1,1-dimethylethyleneimine. The poly(alkyleneimines) useful in the present invention may have molecular weights of from about 100 to about 100,000 or more although the higher molecular weight polymers are not generally as useful since they have a tendency to be insoluble in the zinc plating baths of the invention. Preferably, the molecular weight will be within the range of from about 100 to about 60,000 and more preferably from about 150 to about 2000. Poly(ethyleneimine)s having molecular weights of from about 150 to about 2000 are preferred examples of poly(alkyleneimines). Useful polyethyleneimines are available commercially from, for example, BASF under the designations Lugalvan G-15 (molecular weight 150), Lugalvan G-20 (molecular weight 200) and Lugalvan G-35 (molecular weight 1400).

The poly(alkyleneimines) may be used per se or may be reacted with a cyclic carbonate consisting of carbon, hydrogen and oxygen atoms. A description of the preparation of examples of such reaction products is found in U.S. Pat. Nos. 2,824,857 and 4,162,947, which disclosures are incorporated herein by reference. The cyclic carbonates further are defined as containing ring oxygen atoms adjacent to the carbonyl grouping which are each bonded to a ring carbon atom, and the ring containing said oxygen and carbon atoms has only 3 carbon atoms and no carbon-to-carbon unsaturation.

Useful metal-complexing agents (E) which can be incorporated into the aqueous alkaline plating baths of the present invention include carboxylic acids such as citric acid, tartaric acid, gluconic acid, alpha-hydroxybutyric acid, sodium or potassium salts of said carboxylic acids; polyamines such as ethylenediamine, triethylenetetramine; amino alcohols such as N-(2-aminoethyl)ethanolamine, 2-hydroxyethylaminopropylamine, N-(2-hydroxyethyl)ethylenediamine; etc. When included in the baths of the invention, the amount of metal complexing agent may range from 5 to about 100 g/l, and more often the amount will be in the range of from about 10 to about 30 g/l.

A group of metal complexing agents which is particularly useful in the aqueous alkaline plating baths of the present invention is represented by the formula $$R^3(R^4)N—R^2—N(R^5)R^6 \quad \text{(III)}$$

wherein $R^3$, $R^4$, $R^5$ and $R^6$ are each independently alkyl or hydroxyalkyl groups provided that at least one of $R^3$–$R^6$ is a hydroxyalkyl group, and $R^2$ is a hydrocarbylene group containing up to about 10 carbon atoms. The groups $R^3$–$R^6$ may be alkyl groups containing from 1 to 10 carbon atoms, more often alkyl groups containing from 1 to 5 carbon atoms, or these groups may be hydroxyalkyl groups containing from 1 to 10 carbon atoms, preferably from 1 to about 5 carbon atoms. The hydroxyalkyl groups may contain one or more hydroxyl groups, and preferably at least one of the hydroxyl groups present in the hydroxyalkyl groups is a terminal group. In one preferred embodiment, $R^3$, $R^4$, $R^5$ and $R^6$ are hydroxyalkyl groups.

Specific examples of metal complexing agents characterized by Formula III include N-(2-hydroxyethyl)-N,N',N'-triethylethylenediamine; N,N'-di(2-hydroxyethyl)N,N'-diethyl ethylenediamine; N,N-di(2-hydroxyethyl)-N',N'-diethyl ethylenediamine; N,N,N',N'-tetrakis(2-hydroxyethyl)ethylenediamine; N,N,N',N'-tetrakis(2-hydroxyethyl)propylenediamine; N,N,N',N'-tetrakis(2,3-dihydroxypropyl)ethylenediamine; N,N,N',N'-tetrakis(2,3-dihydroxypropyl)propylenediamine; N,N,N',N'-tetrakis(2-hydroxypropyl)ethylenediamine; N,N,N',N'-tetrakis(2-hydroxyethyl)1,4-diaminobutane; etc. An example of a commercially available metal complexing agents useful in this invention includes Quadrol from BASF. Quadrol is N,N,N',N'-tetrakis(2-hydroxypropyl)ethylenediamine.

Examples of aldehydes which may be included in the plating baths to achieve further improvements in gloss, leveling, etc. include aromatic aldehydes such as anisaldehyde, 4-hydroxy-3-methoxybenzaldehyde (vanillin), 1,3-benzodioxole-5-carboxyaldehyde (piperonal), verateraldehyde, p-tolualdehyde, benzaldehyde, O-chlorobenzaldehyde, 2,3-dimethoxybenzaldehyde, salicylaldehyde, cinamaldehyde, adducts of cinamaldehyde with sodium sulfite, etc. The amount of aldehyde which may be included in the plating baths may range from about 0.01 to about 2 g/l.

The aqueous alkaline plating baths of the invention can be prepared by conventional methods, for example, by adding the specific amounts of the above-described components to water. The amount of the alkali metal base compound such as sodium hydroxide which is included in the mixture should be sufficient to provide the bath with the desired pH of at least 10 and preferably above 11.

The aqueous alkaline plating baths of the present invention deposit a bright, level and ductile zinc-nickel alloy on substrates and any conventional temperature such as from about 25° C. to about 60° C. Generally, temperatures of about 40° C. are utilized. At these temperatures, the plating baths of the invention are stable and effective in depositing bright level deposits over current density ranges of from about 0.5 ASF to about 110 ASF.

The plating baths of the invention may be operated on a continuous or intermittent basis, and from time to time, the components of the bath may have to be replenished. The various components may be added singularly as required or may be added in combination. The amounts of the various compositions to be added to the plating bath may be varied over a wide range depending on the nature and the performance of the zinc-nickel plating baths to which the composition is added. Such amounts can be determined readily by one skilled in the art.

The aqueous alkaline plating baths of the invention can be used over substantially all kinds of substrates on which a zinc-nickel alloy can be deposited. Examples of useful substrates include those of mild steel, spring steel, chrome steel, chrome-molybdenum steel, copper, copper-zinc alloys, etc.

The following examples illustrate the aqueous alkaline plating baths of the invention. The amounts of the components in the following examples are in grams/liter. Unless otherwise indicated in the specification and claims, all parts and percentages are by weight, temperatures are in degrees centigrade, and pressures are at or near atmospheric pressure. In the following examples, the source of zinc ions is zinc oxide in caustic soda, and the source of nickel ions is nickel sulfate.

EXAMPLE 1

An aqueous plating bath is prepared which contains the following components:

| Component | g/l |
|---|---|
| Zinc ions | 8 |
| Nickel ions | 2.2 |
| Sodium hydroxide | 100 |
| Polyethyleneimine (Lugalvan G-20) | 40 |
| Quadrol | 20 |
| Pyridinium-N-propane-3-sulfonic acid | 1.25 |

The efficacy of this aqueous alkaline plating bath and the method of utilizing such a bath for plating substrates is demonstrated by plating 4×2.75 inch steel panels at 2 amps for 15 minutes in a Hull Cell with no agitation at about 40° C. The plating bath produces a bright zinc-nickel alloy deposit over the entire current density range of from 0.5 ASF to 110 ASF.

EXAMPLE 2

| | |
|---|---|
| Zinc ions | 8 |
| Nickel ions | 2.2 |
| Sodium hydroxide | 100 |
| Lugalvan G-20 | 40 |
| Quadrol | 20 |
| Carboxymethylpyridinium chloride | 1.7 |

Steel panels are electroplated in a Hull Cell at 2 amps for 15 minutes at a temperature of about 40° C. A good bright deposit is obtained over the entire current density range.

EXAMPLE 3

| | |
|---|---|
| Zinc ions | 8 |
| Nickel ions | 2.2 |
| Sodium hydroxide | 100 |

-continued

| | |
|---|---|
| Lugalvan G-20 | 40 |
| Quadrol | 20 |
| Pyridinium-N-butane-4-sulfonic acid | 1.5 |

Steel panels are plated in a Hull Cell at 2 amps for 15 minutes at a temperature of about 40° C. and an excellent bright deposit is produced over the entire current density range.

EXAMPLE 4

| | |
|---|---|
| Zinc ions | 8 |
| Nickel ions | 2.2 |
| Sodium hydroxide | 100 |
| Lugalvan G-20 | 40 |
| Quadrol | 20 |
| Pyridinium-N-(2-hydroxy)propane-3-sulfonic acid | 1.7 |

A bright zinc-nickel alloy coating is obtained when steel panels are plated in a Hull Cell at 2 amps for 15 minutes at a temperature of about 40° C. utilizing this plating bath.

EXAMPLE 5

| | |
|---|---|
| Zinc ions | 8 |
| Nickel ions | 2.2 |
| Sodium hydroxide | 100 |
| Polyethyleneimine (Lugalvan G-35) | 40 |
| Quadrol | 20 |
| Carboxymethyl pyridinium chloride | 1.5 |

EXAMPLE 6

| | |
|---|---|
| Zinc ions | 8 |
| Nickel ions | 2.0 |
| Sodium hydroxide | 90 |
| Polyethyleneimine (Lugalvan G-35) | 35 |
| Quadrol | 10 |
| 2-hydroxyethyl pyridinium chloride | 2 |

EXAMPLE 7

| | |
|---|---|
| Zinc ions | 15 |
| Nickel ions | 3 |
| Sodium hydroxide | 100 |
| Polyethyleneimine (Lugalvan G-15) | 45 |
| Quadrol | 10 |
| 2-carboxamidoethyl pyridinium chloride | 1.5 |
| Sodium tartrate | 5 |

EXAMPLE 8

| | |
|---|---|
| Zinc ions | 8 |
| Nickel ions | 2.2 |
| Sodium hydroxide | 100 |
| Lugalvan G-20 | 40 |
| N,N,N',N'-Tetrakis-(2-hydroxyethyl)-ethylenediamine (THEED) | 20 |
| Pyridinium-N-Propane-3-Sulfonic Acid | 1.25 |

Steel panels are electroplated in a Hull Cell at 2 amps for 15 minutes at a temperature of about 40° C. An excellent bright deposit is obtained over the entire current density range.

EXAMPLE 9

| | |
|---|---|
| Zinc ions | 8 |
| Nickel ions | 2.2 |
| Sodium hydroxide | 100 |
| Lugalvan G-20 | 40 |
| N,N,N',N'-Tetrakis-(2-hydroxyethyl)-ethylenediamine (THEED) | 20 |
| Carboxymethyl pyridinium chloride | 1.7 |

Steel panels are electroplated in a Hull Cell at 2 amps for 15 minutes at a temperature of about 40° C. A good bright deposit is obtained over the entire current density range.

EXAMPLE 10

| | |
|---|---|
| Zinc ions | 8 |
| Nickel ions | 2.4 |
| Sodium hydroxide | 100 |
| Lugalvan G-20 | 40 |
| N,N,N',N'-Tetrakis-(2,3-hydroxypropyl)-ethylenediamine | 20 |
| Pyridinium-N-propane-3-sulfonic acid | 1.25 |

Steel panels are electroplated in a Hull Cell at 2 amps for 15 minutes at a temperature of about 40° C. An excellent bright deposit is produced over the entire current density range.

EXAMPLE 11

| | |
|---|---|
| Zinc ions | 8 |
| Nickel ions | 2.2 |
| Sodium hydroxide | 100 |
| Polyethyleneimine (Lugalvan G-35) | 40 |
| N,N,N',N'-Tetrakis-(2,3-hydroxypropyl)-ethylenediamine | 20 |
| Pyridinium-N-(2-hydroxy)-propane-3-sulfonic acid | 1.7 |

A bright zinc nickel alloy coating is obtained on steel panels plated in a Hull Cell at 2 amps for 15 minutes at a temperature of about 40° C. utilizing this plating bath.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. An aqueous alkaline plating bath for the electrodeposition of a zinc-nickel alloy coating on a substrate which comprises (A) zinc ions;

(B) nickel ions; and (C) at least one heterocyclic compound having the general formula $$RN^+—R^1—Y^{(-)a}(X^-)_b \quad (I)$$

wherein RN is an aromatic heterocyclic nitrogen-containing group, $R^1$ is an alkylene or hydroxy alkylene group, Y is $—OSO_3$, $—SO_3$, —COOH, $—CONH_2$ or—OH, X is a halide, a and b=0 or 1, and the sum of a+b=1.

2. The plating bath of claim 1 wherein Y is $—OSO_3$ or $SO_3$, a=1, and b=0.

3. The plating bath of claim 1 wherein Y is —COOH, $—CONH_2$ or —OH, a=0 and b=1.

4. The plating bath of claim 1 wherein RN+ is a pyridinium group.

5. The plating bath of claim 1 wherein $R^1$ is an alkylene or hydroxy alkylene group containing from 1 to about 5 carbon atoms.

6. The plating bath of claim 1 wherein the bath further contains (D) at least one polymer of an aliphatic amine.

7. The plating bath of claim 6 wherein the polymer is a poly(alkyleneimine).

8. The plating bath of claim 6 wherein the polymer is a polyethyleneimine.

9. The plating bath of claim 1 wherein the bath further contains (E) at least one metal-complexing agent characterized by the formula $$R^3(R^4)N—R^2—N(R^5)R^6 \quad (III)$$

wherein $R^3$, $R^4$, $R^5$ and $R^6$ are each independently alkyl or hydroxyalkyl groups provided that at least one of $R^3$–$R^6$ is a hydroxy alkyl group, and $R^2$ is a hydrocarbylene group containing up to about 10 carbon atoms.

10. The plating bath of claim 9 wherein the hydrocarbylene group $R^2$ is an alkylene group containing from 1 to about 10 carbon atoms.

11. The plating bath of claim 9 wherein $R^3$, $R^4$, $R^5$ and $R^6$ in Formula III are hydroxyalkyl groups.

12. An aqueous alkaline plating bath for the electrodeposition of a zinc-nickel alloy coating on a substrate which comprises (A) from about 1 to about 100 g/l of zinc ions;

(B) from about 0.1 to about 50 g/l of nickel ions; and (C) from about 0.1 to about 20 g/l of at least one heterocyclic compound having the general formula $$RN^+—R^1—Y^{(-)a}(X^-)_b \quad (I)$$

wherein RN is an aromatic heterocyclic nitrogen-containing group, $R^1$ is an alkylene or hydroxy alkylene group, Y is $—OSO_3$, $—SO_3$, —COOH, $—CONH_2$ or —OH, X is a halide, a and b=0 or 1, and the sum of a+b=1.

13. The plating bath of claim 12 wherein in Formula I, Y=$SO_3$, a=1 and b=0.

14. The plating bath of claim 12 wherein RN+ in Formula I is a pyridinium group.

15. The alkaline plating bath of claim 12 further containing (D) from about 5 to about 150 g/l of a polymer of an aliphatic amine.

16. The plating bath of claim 5 wherein the polymer of (D) is a poly(alkyleneimine).

17. The plating bath of claim 12 further containing (E) from about 5 to about 100 g/l of at least one metal complexing agent characterized by the formula $$R^3(R^4)N—R^2—N(R^5)R^6 \quad (III)$$

wherein $R^3$, $R^4$, $R^5$ and $R^6$ are each independently hydroxyalkyl groups, and $R^2$ is a hydrocarbylene group containing from 1 to about 5 carbon atoms.

18. The plating bath of claim 17 wherein $R^3$, $R^4$, $R^5$ and $R^6$ in Formula III are hydroxyalkyl groups.

19. An aqueous alkaline plating bath for the electrodeposition of a zinc-nickel alloy coating on a substrate which comprises (A) from about 1 to about 100 g/l of zinc ions;

(B) from about 0.1 to about 50 g/l of nickel ions;

(C) from about 0.1 to about 10 g/l of at least one heterocyclic compound having the general formula $$RN^{+}—R^{1}—Y^{-} \quad (IA)$$

wherein RN is an aromatic heterocyclic nitrogen-containing group, $R^1$ is an alkylene or hydroxy alkylene group and Y is $—SO_3$, —COOH, $—CONH_2$ or —OH;

(D) from about 5 to about 150 g/l of a poly(alkyleneimine); and (E) from about 5 to about 100 g/l of at least one polyamine metal-complexing agent characterized by the formula $$R^3(R^4)N—R^2—N(R^5)R^6 \quad (III)$$

wherein $R^2$ is a hydrocarbylene group containing up to about 10 carbon atoms, and $R^3$, $R^4$, $R^5$ and $R^6$ are each independently hydroxyalkyl groups.

20. The method of electrodepositing a bright and level zinc-nickel alloy coating on a substrate which comprises electroplating said substrate with the aqueous alkaline plating bath of claim 1.

21. The method of depositing a bright and level zinc-nickel alloy coating on a substrate which comprises electroplating said substrate with the aqueous alkaline plating bath of claim 12.

22. The method of depositing a bright and level zinc-nickel alloy coating on a substrate which comprises electroplating said substrate with the aqueous alkaline plating bath of claim 19.

* * * * *